US010215499B2

(12) United States Patent
Chen et al.

(10) Patent No.: US 10,215,499 B2
(45) Date of Patent: Feb. 26, 2019

(54) HEAT DISSIPATION DEVICE

(71) Applicant: ASIA VITAL COMPONENTS CO., LTD., New Taipei (TW)

(72) Inventors: Chih-Peng Chen, New Taipei (TW); Huang-Pin Shen, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 210 days.

(21) Appl. No.: 14/820,563

(22) Filed: Aug. 7, 2015

(65) Prior Publication Data

US 2017/0038153 A1 Feb. 9, 2017

(51) Int. Cl.
*F28D 15/02* (2006.01)

(52) U.S. Cl.
CPC ..... *F28D 15/02* (2013.01)

(58) Field of Classification Search
CPC ..... F28D 15/0275; F28D 15/02; F28F 1/14; F28F 1/325; F28F 1/16; F28F 1/18; F28F 1/20; F28F 1/24; F28F 1/26; F28F 1/28; F28F 1/30; F28F 1/32; F28F 1/34; F28F 1/36; F28F 1/38
See application file for complete search history.

(56) References Cited

U.S. PATENT DOCUMENTS 2,418,619 A * 4/1947 Brown, Jr. ..... F28F 1/12 165/183
3,189,087 A * 6/1965 Parris ..... F28F 1/30 165/181
5,309,982 A * 5/1994 Aliano ..... F28F 1/30 165/181
6,640,888 B1 * 11/2003 Horng ..... F28F 1/24 165/182
6,892,801 B1 * 5/2005 Kim ..... F28D 15/0275 165/104.21
7,861,768 B1 * 1/2011 Ghantiwala ..... F28D 15/0275 165/104.21
8,453,714 B2 * 6/2013 Li ..... F28D 15/0275 165/104.19
9,664,453 B2 * 5/2017 Huang ..... F28D 15/02
2008/0094800 A1 * 4/2008 Chen ..... F28F 1/20 361/704

(Continued)

*Primary Examiner* — Frantz F Jules
*Assistant Examiner* — Nelson J Nieves
(74) *Attorney, Agent, or Firm* — Jackson IPG PLLC; Demian K. Jackson

(57) ABSTRACT

A heat dissipation device includes a covering member, a heat pipe, and a heat dissipation unit. The covering member has a hollow C-shaped fitting portion, in which the heat pipe is fitted to tightly connect to the covering member. At least one first heat transfer portion is outwardly extended from a periphery of the C-shaped fitting portion of the covering member. The heat dissipation unit has a plurality of parallelly spaced heat radiation fins, each of which has a through hole formed thereon, and at least one first locating slot is outwardly extended from the through hole. When the C-shaped fitting portion and the first heat transfer portion are respectively extended through the through holes and the first locating slots, the covering member is connected to the heat dissipation unit. With the first heat transfer portion, the heat dissipation device can have enhanced heat transfer and dissipation effect.

3 Claims, 14 Drawing Sheets

(56) References Cited

U.S. PATENT DOCUMENTS

2008/0105408 A1* 5/2008 Zhang ..... B23K 1/0012 165/104.33
2008/0121370 A1* 5/2008 Luo ..... H01L 23/427 165/80.3
2009/0154103 A1* 6/2009 Liu ..... H01L 23/427 361/700
2009/0195988 A1* 8/2009 Hongo ..... G06F 1/203 361/709
2010/0059207 A1* 3/2010 Chang ..... F28D 15/02 165/104.26
2010/0259897 A1* 10/2010 Min ..... F28D 15/0275 361/700
2011/0100604 A1* 5/2011 Anzai ..... B21D 53/08 165/104.21
2011/0155351 A1* 6/2011 Li ..... F28D 15/0275 165/104.26
2011/0297356 A1* 12/2011 Hsieh ..... F28D 15/0233 165/104.26
2011/0308776 A1* 12/2011 Huang ..... H01L 23/3672 165/121
2012/0031589 A1* 2/2012 Lin ..... F28D 15/02 165/104.26
2013/0063958 A1* 3/2013 Wang ..... F28D 15/02 362/382
2013/0146255 A1* 6/2013 Kim ..... F28D 1/0308 165/104.13
2014/0131014 A1* 5/2014 Lin ..... F28D 15/02 165/104.26
2014/0154548 A1* 6/2014 Dillmann ..... H01M 10/5004 429/120
2014/0184050 A1* 7/2014 Mizuta ..... F21V 29/717 313/35
2015/0144307 A1* 5/2015 Lin ..... H05K 7/20336 165/104.21
2017/0307304 A1* 10/2017 Hirasawa ..... F28F 1/325

* cited by examiner

HEAT DISSIPATION DEVICE

FIELD OF THE INVENTION

The present invention relates to a heat dissipation device, and more specifically, to a heat dissipation device having largely increased heat transfer effect and heat dissipation efficiency

BACKGROUND OF THE INVENTION

With the advancement of technology, the number of transistors on per unit area of an electronic element is constantly increased to produce a largely increased amount of heat when the electronic element operates. Also, the operating frequency of the electronic element is higher and higher. Switching on/off of the transistors in operation generates heat as well, which also forms one reason why the electronic elements generate more heat than ever before. The produced heat must be quickly removed from the electronic element, or the heat can lower the computation speed of chips. In a worse condition, the heat can adversely affect the service life of the chips. To improve the heat dissipation efficiency of the electronic element, heat radiation fins of a heat sink are used to dissipate the heat from the electronic elements into the ambient air through natural or forced convection.

A heat pipe has a very small cross sectional area but it enables transfer of a large amount of heat from a point to another distant point for dissipation even though there is only a small temperature difference between the two points, and its operation does not need an applied power supply. With these advantages, heat pipes have been widely used in various heat-producing electronic products as one of the widely adopted heat transfer elements.

A currently very popular way of heat dissipation is to mount a heat dissipation device, such as a heat sink, especially a heat sink with heat pipes, to a heat-generating element. The heat sink is made of a material having high heat conductivity. Also, with the help of a working fluid and a wick structure provided in the heat pipe, the heat sink not only provides high heat transfer ability, but also has advantageous light weight to reduce the overall weight, production cost, and system complexity caused by the heat dissipation device.

A conventional heat sink with heat pipe includes a plurality of heat radiation fins and at least one heat pipe. Each of the heat radiation fins has at least one through hole formed thereon for the heat pipe to extend through, such that the heat pipe is connected to the heat radiation fins. However, the conventional heat pipe usually has a round or an oval cross section, which provides only a point-to-point contact and accordingly, a very small contact area between the heat pipe and the heat radiation fins, resulting in slow and poor heat transfer effect of the heat sink.

In conclusion, the prior art heat dissipation device has the following disadvantages: (1) having low heat transfer effect; and (2) having poor heat dissipation efficiency.

It is therefore tried by the inventor to develop an improved heat dissipation device to overcome the drawbacks and problems in the conventional heat dissipation device.

SUMMARY OF THE INVENTION

To solve the above and other problems, a primary object of the present invention is to provide a heat dissipation device that provides largely increased heat transfer effect and heat dissipation efficiency.

Another object of the present invention is to provide a heat dissipation device that can dissipate heat more quickly.

To achieve the above and other objects, the heat dissipation device according to the present invention includes a covering member, a heat pipe, and a heat dissipation unit. The covering member has a hollow C-shaped fitting portion, in which the heat pipe is fitted to tightly connect to the covering member. At least one first heat transfer portion is outwardly extended from a periphery of the C-shaped fitting portion. The first heat transfer portion can be an integral body axially extended along the C-shaped fitting portion, or include a plurality of sections axially spaced along the C-shaped fitting portion. The heat pipe is fitted in and connected to the C-shaped fitting portion by solder pasting, welding, tight fitting, or gluing. The heat dissipation unit has a plurality of parallelly spaced heat radiation fins, each of which has a through hole formed thereon and at least one first locating slot is outwardly extended from the through hole. When the C-shaped fitting portion and the first heat transfer portion are correspondingly extended through the through holes and the first locating slots, respectively, the covering member is connected to the heat dissipation unit.

With the heat pipe fitted in the C-shaped fitting portion that has the first heat transfer portion integrally extended therefrom, heat from a heat source in contact with the heat pipe is first transferred to the heat pipe and the covering member, and the heat is then transferred quickly from the heat pipe and the C-shaped fitting portion of the covering member to the first heat transfer portion. Then the heat is transferred from the first heat transfer portion to the heat radiation fins. The first heat transfer portion provides an increased heat transfer area, enabling the heat dissipation device to have largely enhanced heat transfer effect and heat dissipation efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
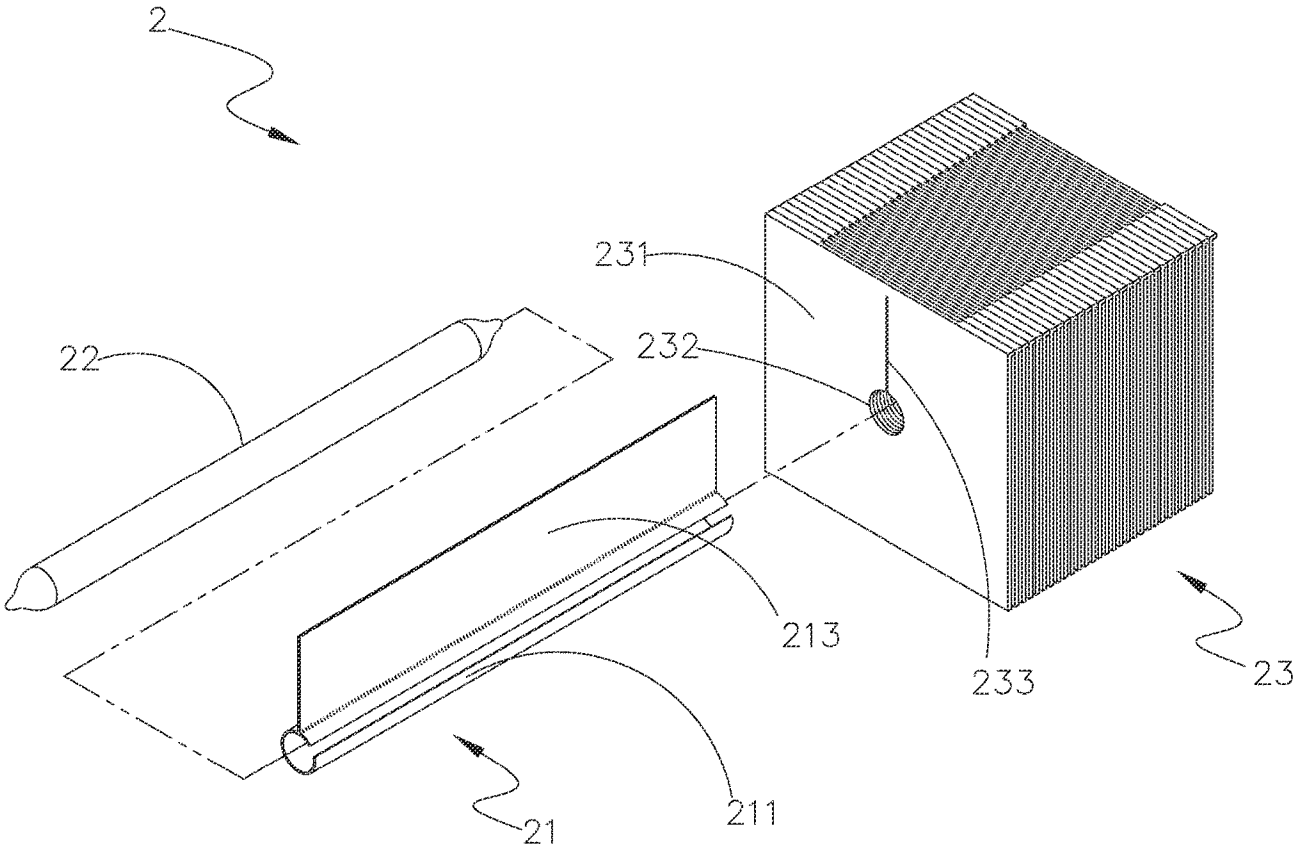
FIG. 1 is an exploded perspective view of a heat dissipation device according to a first embodiment of the present invention.

The present invention will now be described with some preferred embodiments thereof and by referring to the accompanying drawings. For the purpose of easy to understand, elements that are the same in the preferred embodiments are denoted by the same reference numerals.

Figure 2:
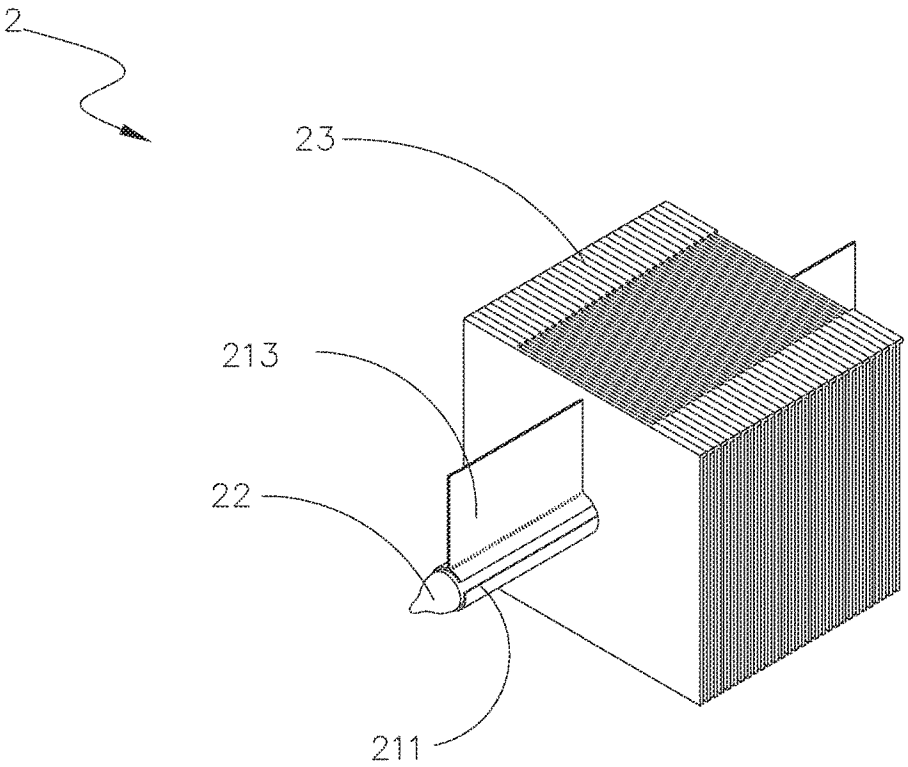
FIG. 2 is an assembled perspective view of FIG. 1.
Figure 3:
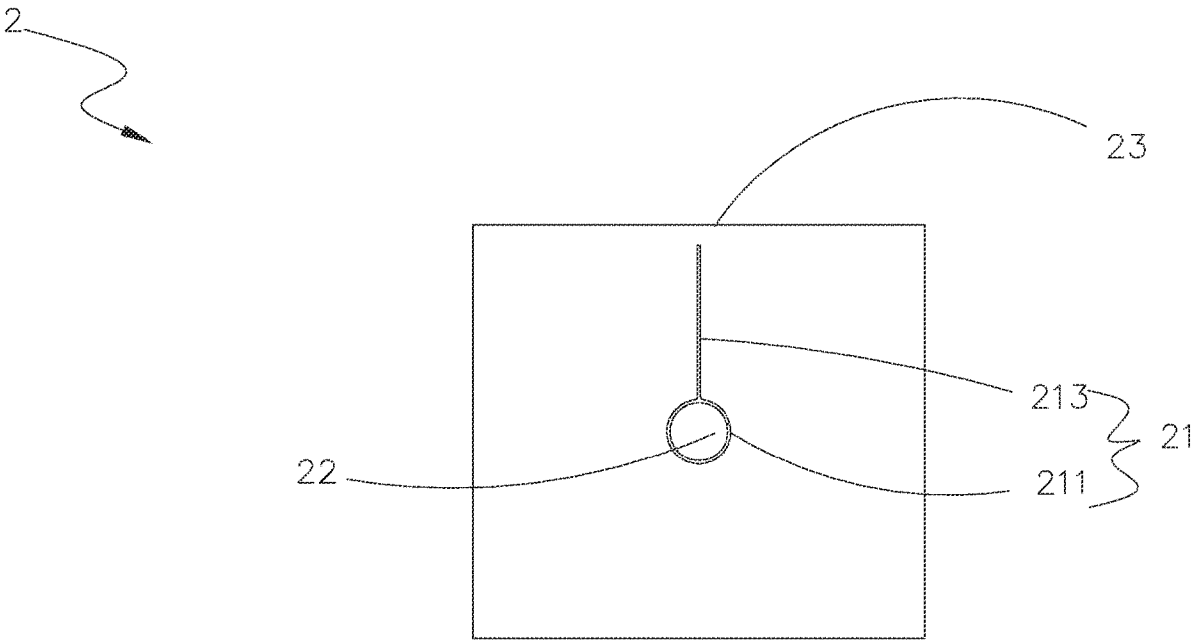
FIG. 3 is a front view of FIG. 2.
Figure 4:
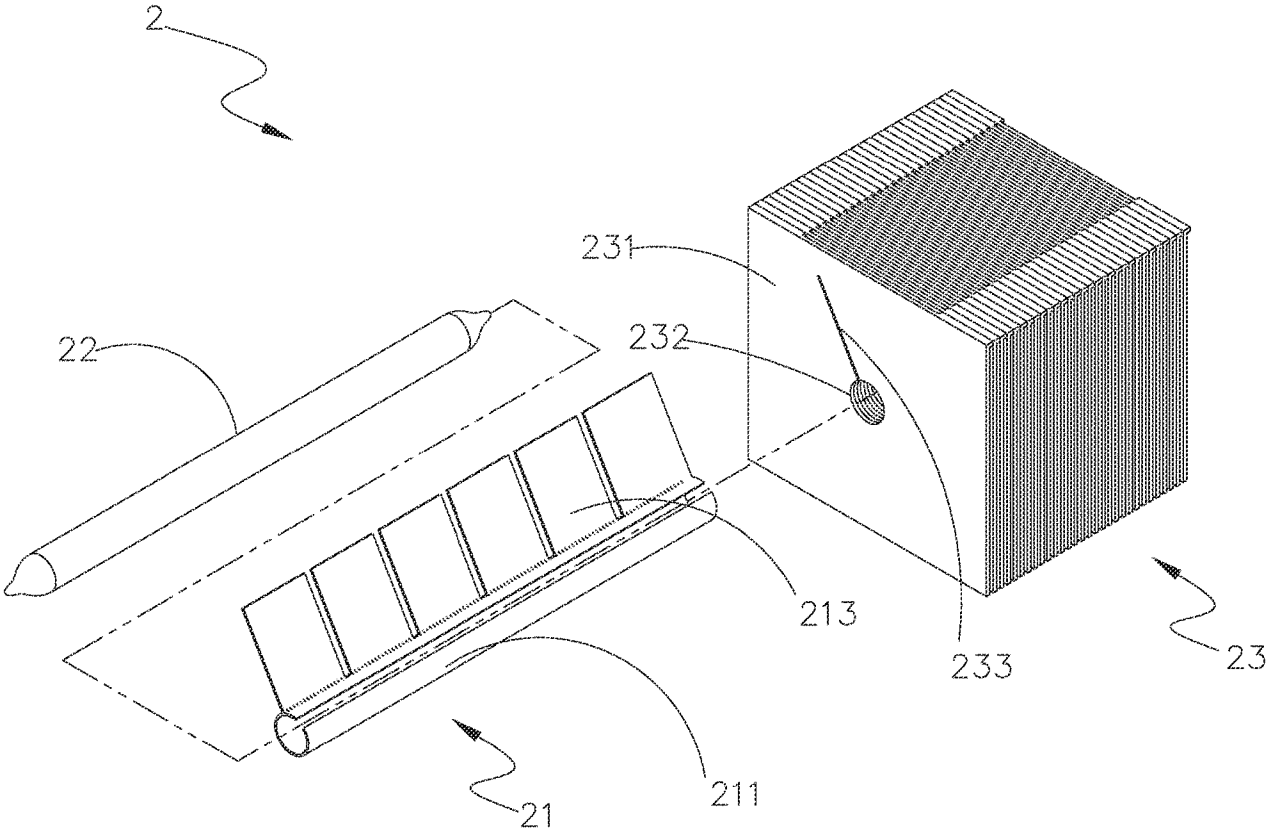
FIG. 4 is an exploded perspective view of the heat dissipation device according to a second embodiment of the present invention.

Please refer to FIGS. 1 and 2, which are exploded and assembled perspective views, respectively, of a heat dissipation device 2 according to a first preferred embodiment of the present invention, and to FIG. 3, which is a front view of FIG. 2. As shown, the heat dissipation device 2 includes a covering member 21, a heat pipe 22, and a heat dissipation unit 23. The covering member 21 has a C-shaped fitting portion 211. At least one first heat transfer portion 213 is integrally outwardly extended from a periphery of the C-shaped fitting portion 211. In the first embodiment, the first heat transfer portion 213 is an integral body axially extended along the C-shaped fitting portion 211. However, in a second embodiment of the present invention as shown in FIG. 4, the first heat transfer portion 213 includes a plurality of sections axially spaced along the C-shaped fitting portion 211 to radially outward extend in the same direction. Or, in another operable embodiment not shown in the drawings, the spaced sections of the first heat transfer portion 213 can be radially outward extended in different directions to be in a staggered relation with respect to one another. The C-shaped fitting portion 211 of the covering member 21 is fixedly fitted around and connected to the heat pipe 22 by solder pasting, welding, tight fitting, or gluing.

The heat dissipation unit 23 has a plurality of parallelly spaced heat radiation fins 231, each of which has a through hole 232 formed thereon and at least one first locating slot 233 extended radially outwardly from the through hole 232. The C-shaped fitting portion 211 and the first heat transfer portion 213 are correspondingly extended through the through holes 232 and the first locating slots 233, respectively, to thereby connect to the heat dissipation unit 23.

Figure 5:
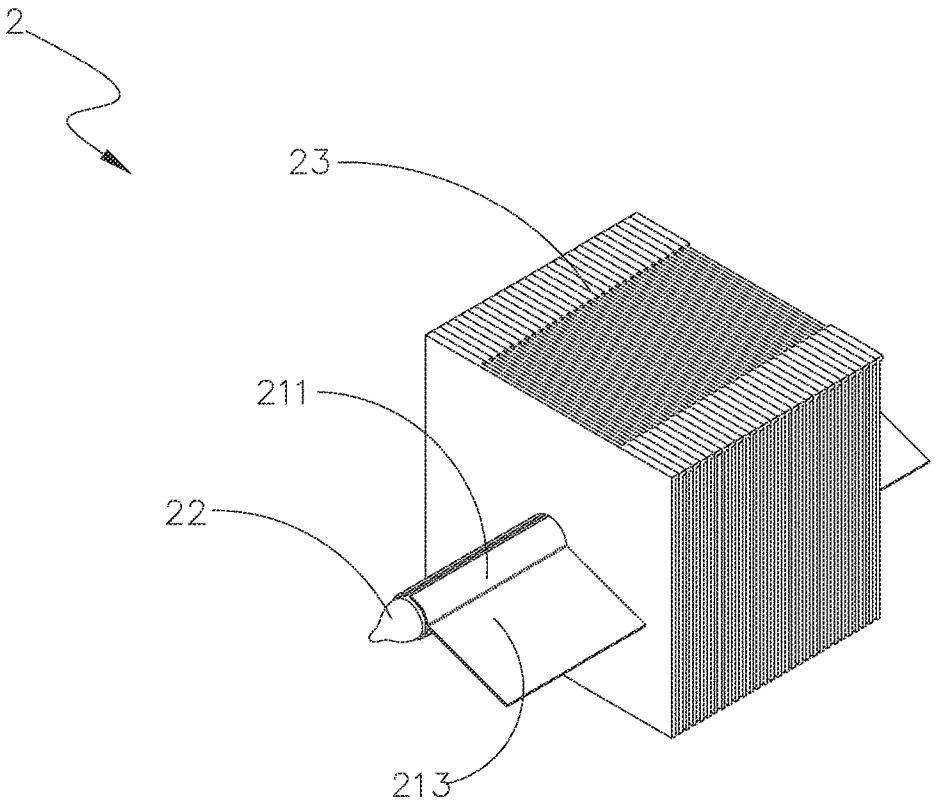
FIG. 5 is an assembled perspective view of the heat dissipation device according to a third embodiment of the present invention.
Figure 6:
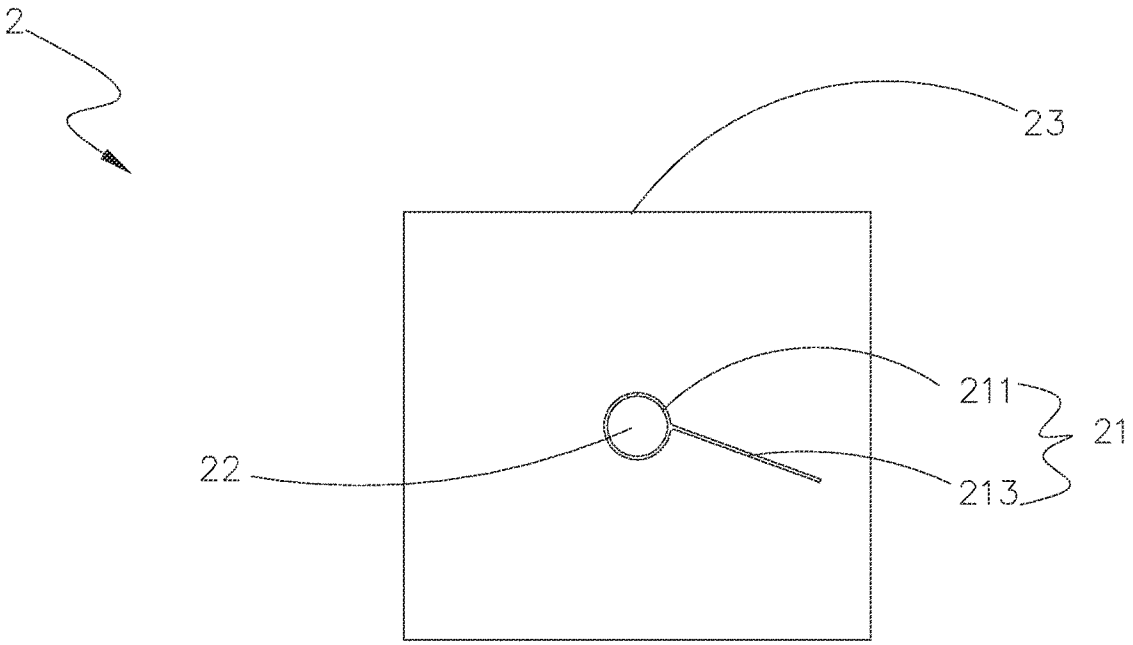
FIG. 6 is a front view of FIG. 5.

In the first embodiment, the first heat transfer portion 213 is perpendicular to the C-shaped fitting member 211, so that the first locating slot 233 is also perpendicular to the through hole 232. However, in a third embodiment of the present invention as shown in FIGS. 5 and 6, which are assembled perspective view and front view, respectively, of the heat dissipation device 2 according to the third preferred embodiment, the first heat transfer portion 213 is not perpendicular to the C-shaped fitting member 211. Therefore, the first locating slot 233 is also slantingly extended from the through hole 232 corresponding to the first heat transfer portion 213. Further, in the illustrated first embodiment, the covering member 21 has a round cross section, so the heat pipe 22 also has a round cross section.

The first heat transfer portion 213 gives the covering member 21 an increased heat transfer area. With the large contact area between the first heat transfer portion 213 and the heat radiation fins 231, the heat dissipation device 2 can have increased heat transfer area, enabling quick transfer of heat from the first heat transfer portion 213 to the heat dissipation unit 23 to largely enhance the overall heat dissipation efficiency of the heat dissipation device 2.

Figure 7:
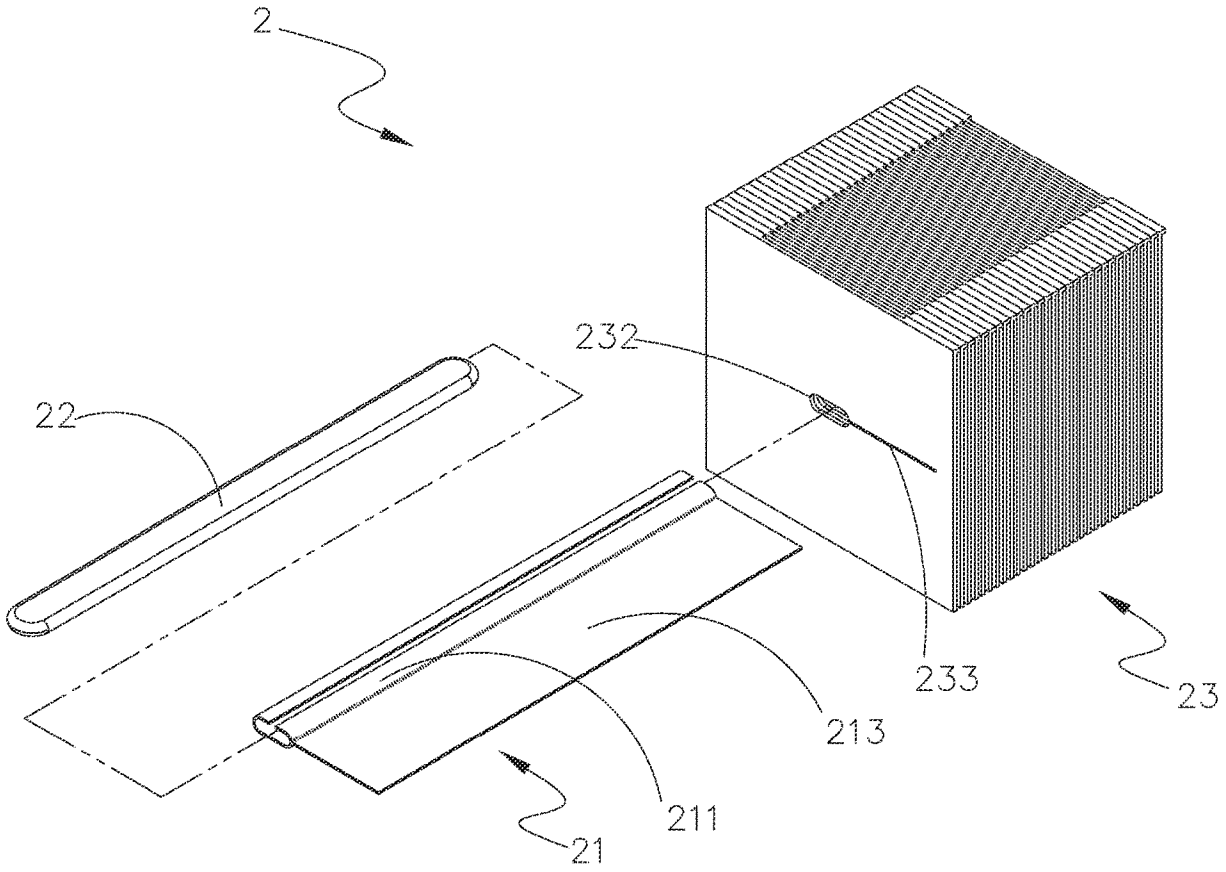
FIG. 7 is an exploded perspective view of the heat dissipation device according to a fourth embodiment of the present invention.

Please refer to FIG. 7, which is an exploded perspective view of the heat dissipation device 2 according to a fourth embodiment of the present invention. The fourth embodiment of the heat dissipation device 2 is generally structurally similar to the first embodiment except that, in the fourth embodiment, the covering member 21 has a flat cross section, so the heat pipe 22 also has a flat cross section. In practical implementation of the present invention, the covering member 21 and the heat pipe 22 can be correspondingly configured to have an oval or any other shaped cross section according to the actual needs in use.

Figure 8:
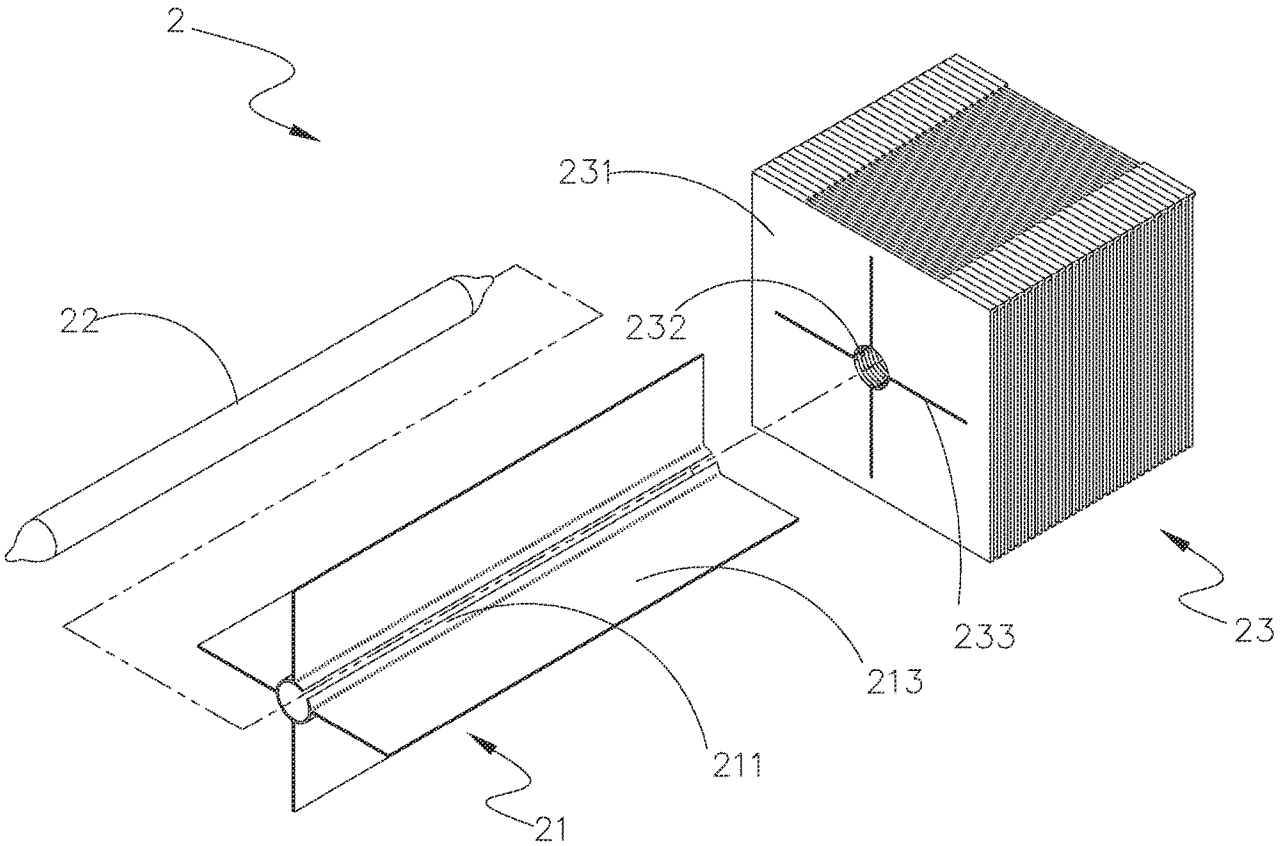
FIG. 8 is an exploded perspective view of the heat dissipation device according to a fifth embodiment of the present invention.

Please refer to FIG. 8, which is an exploded perspective view of the heat dissipation device 2 according to a fifth embodiment of the present invention. The fifth embodiment of the heat dissipation device 2 is generally structurally similar to the first embodiment except that, in the fifth embodiment, four first heat transfer portions 213 are radially outwardly extended from the periphery of the C-shaped fitting portion 211 of the covering member 21, and four first locating slots 233 corresponding to the four first heat transfer portions 213 are radially outwardly extended from the through hole 232. By extending the four first heat transfer portions 213 through the four first locating slots 233, the covering member 21 is connected to the heat dissipation unit 23. In practical implementation of the present invention, the number of the first heat transfer portions 213 can be increased according to the actual needs in use.

Figure 9:
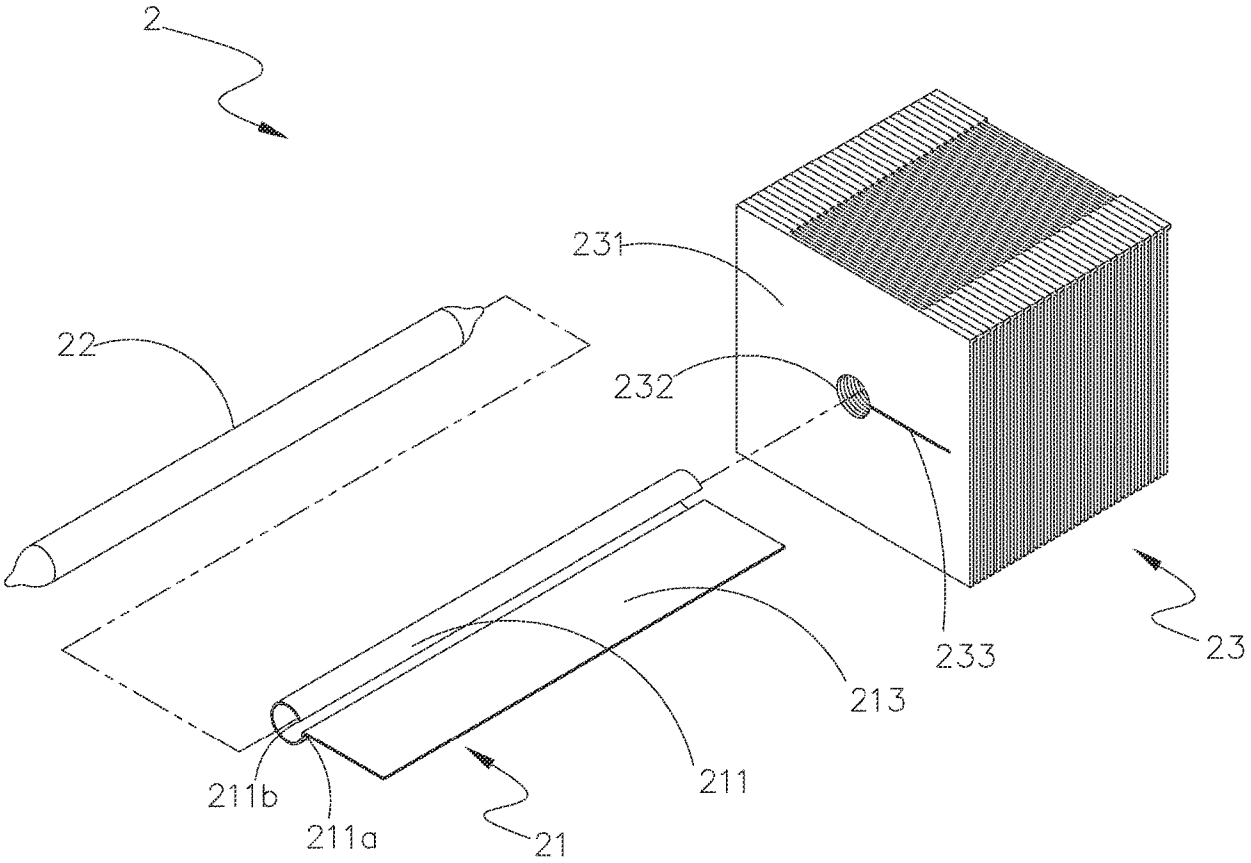
FIG. 9 is an exploded perspective view of the heat dissipation device according to a sixth embodiment of the present invention.

Please refer to FIG. 9, which is an exploded perspective view of the heat dissipation device 2 according to a sixth embodiment of the present invention. The sixth embodiment of the heat dissipation device 2 is generally structurally similar to the first embodiment except that, in the sixth embodiment, the C-shaped fitting portion 211 has a first and a second longitudinal edge 211*a*, 211*b*. The first heat transfer portion 213 is outwardly extended from the first longitudinal edge 211*a* of the C-shaped fitting portion 211, and the first locating slot 233 is outwardly extended from the through hole 232 formed on each heat radiation fin 231 to correspond to the first heat transfer portion 213. By extending the first heat transfer portion 213 through the first locating slots 233, the covering member 21 is connected to the heat dissipation unit 23.

Figure 10:
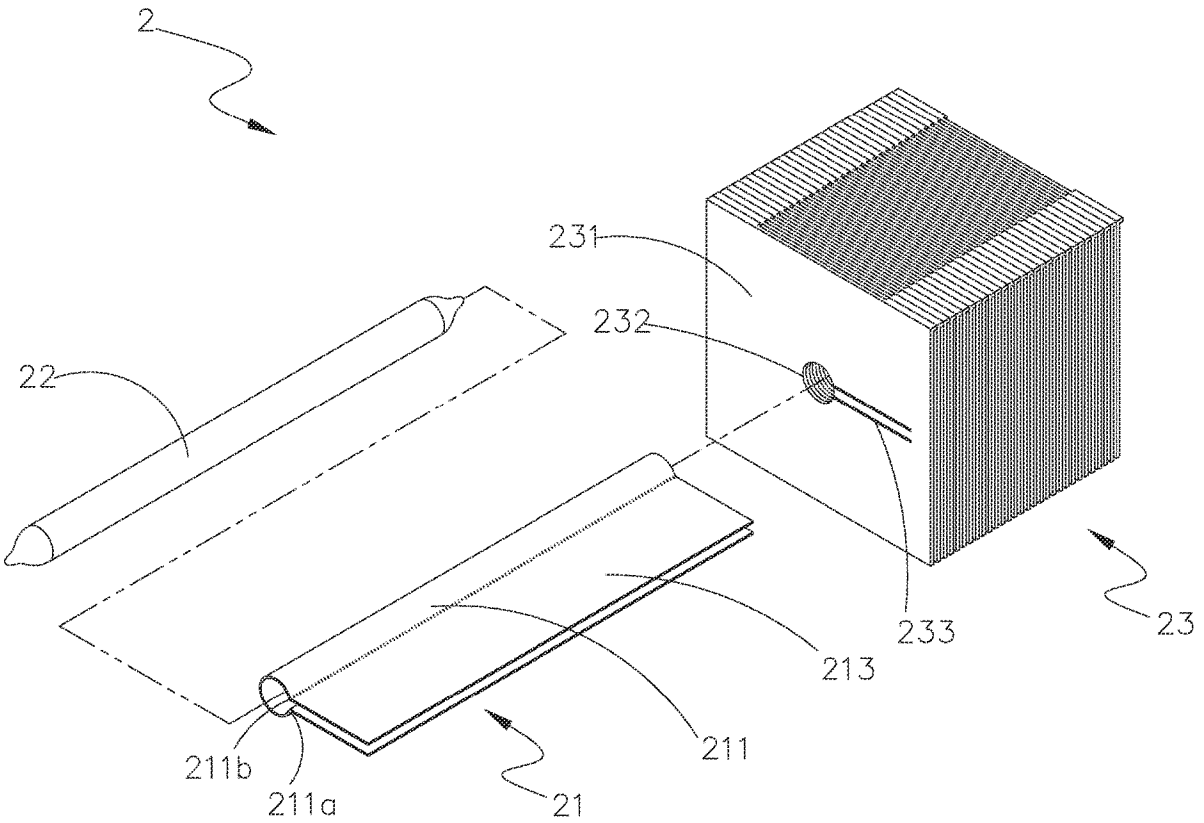
FIG. 10 is an exploded perspective view of the heat dissipation device according to a seventh embodiment of the present invention.

Please refer to FIG. 10, which is an exploded perspective view of the heat dissipation device 2 according to a seventh embodiment of the present invention. The seventh embodiment of the heat dissipation device 2 is generally structurally similar to the sixth embodiment except that, in the seventh embodiment, two first heat transfer portions 213 are separately outwardly extended from the first and the second longitudinal edge 211*a*, 211*b*, and two first locating slots 233 are outwardly extended from the through hole 232 to correspond to the two first heat transfer portions 213. By extending the two first heat transfer portions 213 through the two first locating slots 233, the covering member 21 is connected to the heat dissipation unit 23.

Figure 11:
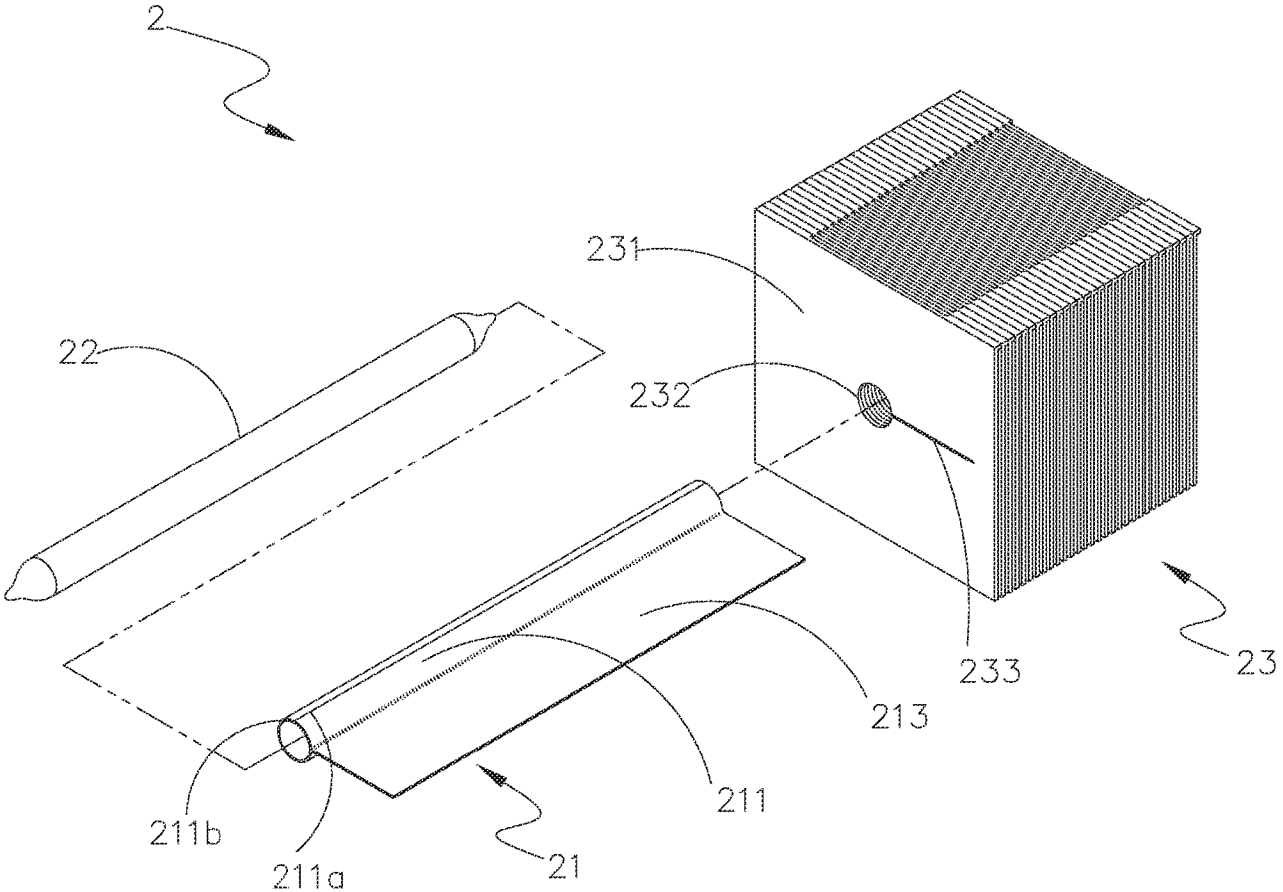
FIG. 11 is an exploded perspective view of the heat dissipation device according to an eighth embodiment of the present invention.

Please refer to FIG. 11, which is an exploded perspective view of the heat dissipation device 2 according to an eighth embodiment of the present invention. The eighth embodiment of the heat dissipation device 2 is generally structurally similar to the first embodiment except that, in the eighth embodiment, the C-shaped fitting portion 211 has a first and a second longitudinal edge 211*a*, 211*b* connected to each other to thereby form a closed round pipe. Again, the first locating slot 233 corresponding to the first heat transfer portion 213 is outwardly extended from the through hole 232 formed on each heat radiation fin 231. By extending the first heat transfer portion 213 through the first locating slots 233, the covering member 21 is connected to the heat dissipation unit 23.

Figure 12:
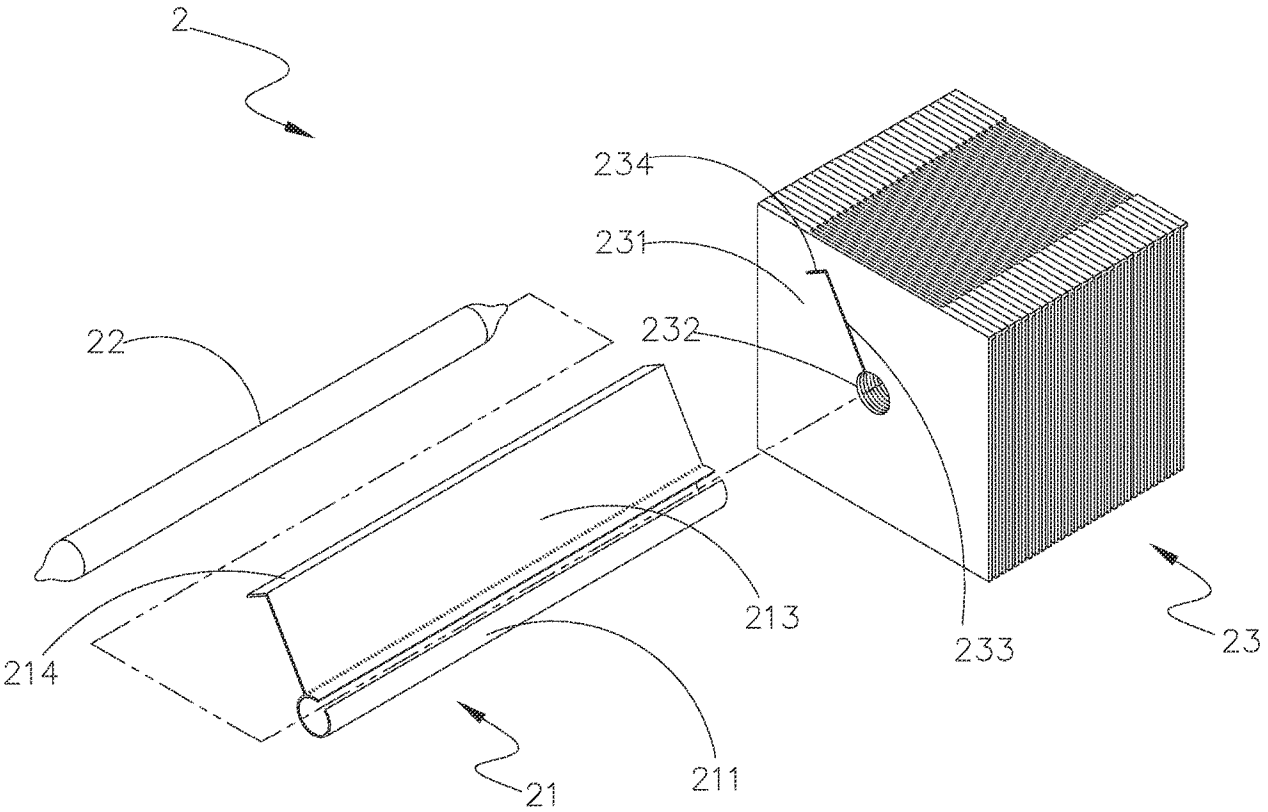
FIG. 12 is an exploded perspective view of the heat dissipation device according to a ninth embodiment of the present invention.
Figure 13:
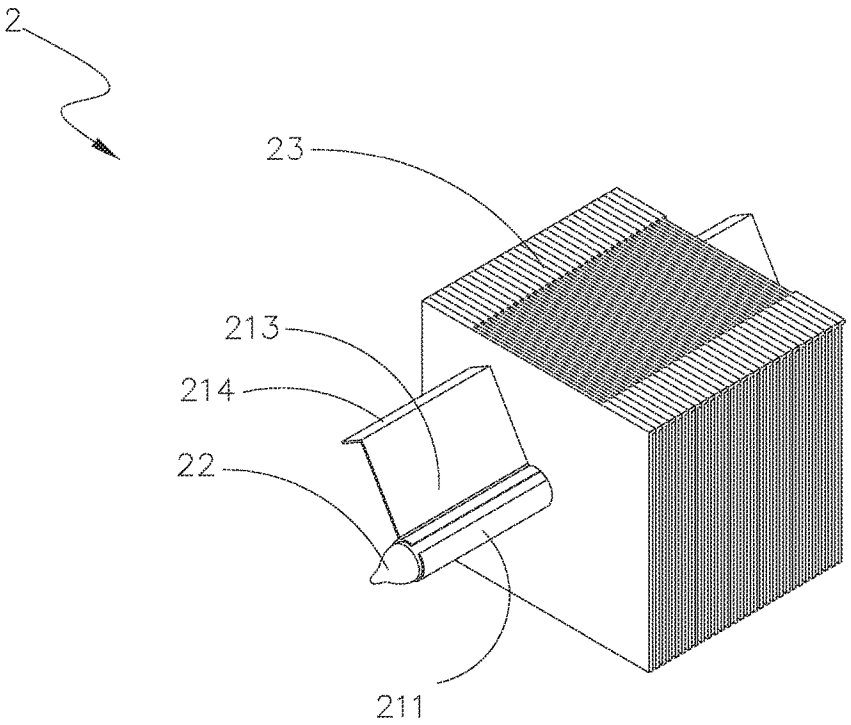
FIG. 13 is an assembled perspective view of FIG. 12.

Please refer to FIGS. 12 and 13, which are exploded and assembled perspective views, respectively, of the heat dissipation device 2 according to a ninth embodiment of the present invention. The ninth embodiment of the heat dissipation device 2 is generally structurally similar to the first embodiment except that, in the ninth embodiment, the first heat transfer portion 213 further has a second heat transfer portion 214 integrally outwardly extended therefrom, such that an angle larger than 0 and smaller than 360 degrees is included between the first and the second heat transfer portion 213, 214. And, the first locating slot 233 is correspondingly outwardly extended to form a second locating slot 234, allowing the second heat transfer portion 214 to be correspondingly extended through the second locating slots 234.

With the first and second heat transfer portions 213, 214 extended from the periphery of the C-shaped fitting portion 211, heat can be transferred quickly from the heat pipe 22 and the C-shaped fitting portion 211 of the covering member 21 to the first heat transfer portion 213 and the second transfer section 214, and finally to the heat radiation fins 231, from where the heat is dissipated into the surrounding environment. With these arrangements, the heat dissipation device 2 not only has increased heat transfer area, but also largely enhanced heat dissipation efficiency.

Figure 14:
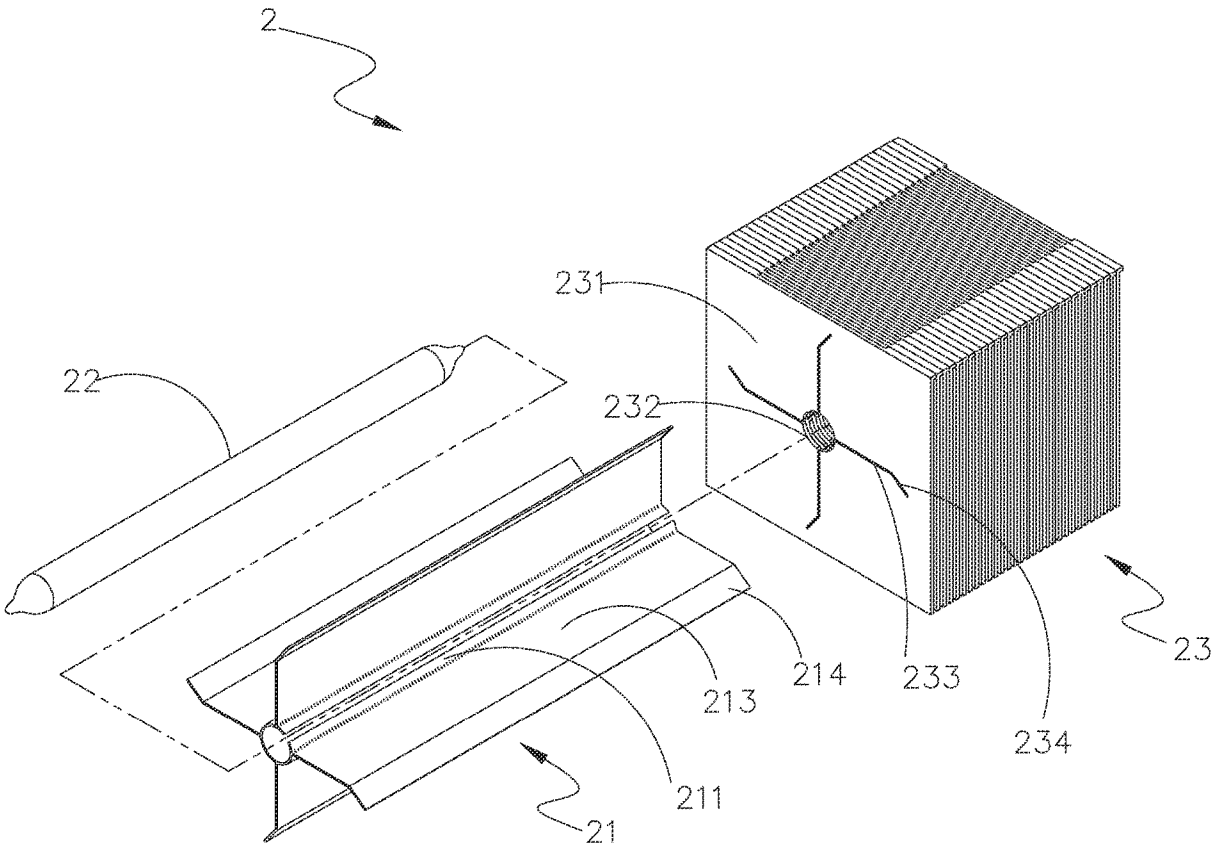
FIG. 14 is an exploded perspective view of the heat dissipation device according to a tenth embodiment of the present invention.

Please refer to FIG. 14, which is an exploded perspective view of the heat dissipation device 2 according to a tenth embodiment of the present invention. The tenth embodiment of the heat dissipation device 2 is generally structurally similar to the first embodiment except that, in the tenth embodiment, the C-shaped fitting portion 211 of the covering member 21 has four first heat transfer portions 213 outwardly extended from the periphery thereof, and each of the first heat transfer portions 213 further has a second heat transfer portion 214 outwardly extended therefrom. Meanwhile, there are four first locating slots 233 outwardly extended from the through hole 232 formed on each heat radiation fin 231 to correspond to the four first heat transfer portions 213, and each of the first locating slots 233 further has a second locating slot 234 outwardly extended therefrom to correspond to the second heat transfer portion 214. By extending the first and the second heat transfer portions 213, 214 through the first and the second locating slots 233, 234, respectively, the covering member 21 is tightly connected to the heat dissipation unit 23. However, in practical implementation of the present invention, the number of the first and the second heat transfer portions 213, 214, and accordingly, the first and the second locating slots 233, 234 can be increased according to the actual needs in use.

In brief, the heat dissipation device according to the present invention has the following advantages: (1) having large contact area between the heat radiation fins and the first heat transfer portions to enable good heat transfer effect; (2) having faster heat dissipation speed; and (3) having largely enhanced heat dissipation efficiency.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A heat dissipation device consisting of:

a preformed covering member having a hollow C-shaped fitting portion formed with a receiving portion and an opening and a first heat transfer plate integrally outwardly extended from a periphery of the C-shaped fitting portion and defining only a single layer;

a heat pipe disposed in the receiving portion; and a heat dissipation unit having a plurality of parallelly spaced heat radiation fins; each of the heat radiation fins having a through hole formed thereon, and the through hole having at least one first locating slot outward extended therefrom; and the C-shaped fitting portion and the first heat transfer plate correspondingly extended through the through holes and the first locating slots, respectively, to thereby connect to the heat dissipation unit and the first heat transfer plate extending to a periphery of the heat radiation fins so as to increase heat transfer area and provide remote heat dissipation.

2. The heat dissipation device as claimed in claim 1, wherein the first heat transfer plate is a single integral body axially extended along the C-shaped fitting portion, or includes a plurality of sections axially spaced along the C-shaped fitting portion.

3. The heat dissipation device as claimed in claim 1, wherein the heat pipe is connected to the C-shaped fitting portion by tight fitting.

* * * * *